US005147041A

United States Patent [19]

Lemieux et al.

[11] Patent Number: 5,147,041

[45] Date of Patent: Sep. 15, 1992

[54] STORAGE CONTAINER FOR SPORTS CARDS

[76] Inventors: Richard Lemieux, 4022, 918-16th Ave., N.W., Calgary, AB, Canada, T2M 0K3; Terrence Neufeld, 1088, Marcombe Drive N.E., Calgary, AB, Canada, T2A 4J8

[21] Appl. No.: 692,989

[22] Filed: Apr. 29, 1991

[51] Int. Cl.[5] ..... B65D 25/54; B65D 85/48

[52] U.S. Cl. ..... 206/449; 220/602; 220/532; 220/23.83; 206/425; 206/555; 206/455; 206/815; 217/63; 217/11; 312/330.1

[58] Field of Search ..... 220/532, 602, 23.83, 220/456, 455, 815, 449, 555, 556, 425; 206/456, 455, 815, 449, 555, 556, 425; 217/63, 17, 10, 11, 5; 312/330.1

[56] References Cited

U.S. PATENT DOCUMENTS

| | | | |
|---|---|---|---|
| 173,360 | 2/1876 | Snider et al. | 217/63 |
| 382,716 | 5/1888 | Matthews | 206/425 |
| 1,329,139 | 1/1920 | Parker | 312/330.1 X |
| 1,845,470 | 2/1932 | Wood | 206/425 X |

*Primary Examiner*—William I. Price

[57] ABSTRACT

A generally rectangular container for the storage and protection of sports cards having a rigid Internal Enclosure (6) which is slidably insertable and completely removable from a rigid External Enclosure (8).

The External Enclosure (8) incorporates two Finger-grip cutouts (8a) and (8a') located to the front and to either side of the External Enclosure (8) to permit grasping the Internal Enclosure (6) for removal. The Internal Enclosure (6) has the capacity to store a plurality of cards and permit random access of such cards by utilizing spaced Bottom Rails (6a) and (6a') which create a gap sufficient for the insertion of a finger or fingers to raise any specific card, or series of cards, up and out of the card stack. The front panel insert (10) to the Internal Enclosure (6) is transparent, thus permitting visibility of the first card in any sequential ordering of cards.

7 Claims, 6 Drawing Sheets

STORAGE CONTAINER FOR SPORTS CARDS

FIELD OF INVENTION

Figure 1:
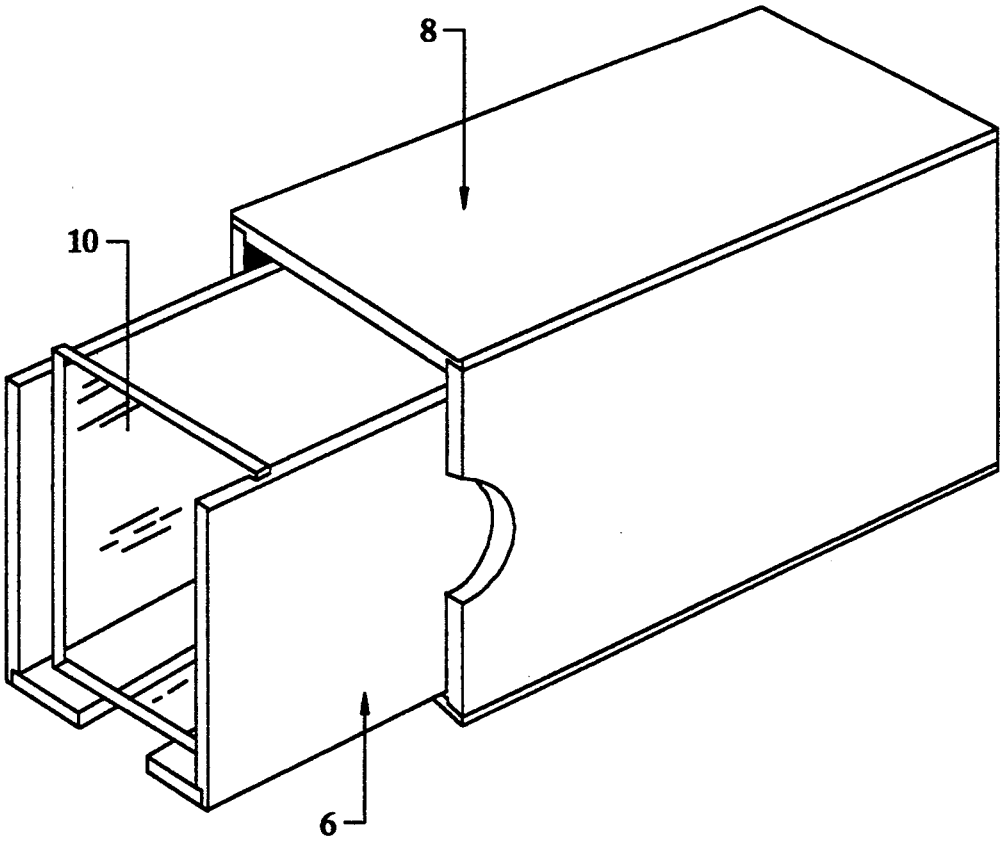

This invention relates to the protection and storage of cardstock cards, specifically sports cards, (baseball, basketball, hockey etc.)

DESCRIPTION OF PRIOR ART

Collecting sports cards has long been a popular North American hobby. Over the years many such cards have acquired significant economic value. Such value is determined in large part by the physical condition of a particular card.

Initially, hobbyists and more serious collectors tended to store cards in any available container. These ranged from discarded shoe boxes to metal tins.

As it became evident that cards in pristine physical condition commanded higher prices than otherwise, various containers were devised specifically for card storage.

Soft, mylar "envelopes" are often used for storage of individual cards. While certainly a step up from no protection, these devices are limited in their usefulness. Being composed of flexible material they offer little protection from bending and twisting of the enclosed card. They provide no effective means of organizing cards in logical sequence by number or player. And they are capable of accommodating single cards only.

Also available are soft plastic sheets containing multiple "pockets". Each pocket is capable of holding a single card. These sheets are generally punched along one edge to render them mountable in a standard 3-ring binder. This storage system overcomes the organizational problems inherent with the "envelope" system but provides little protection to the card from bending and twisting. In anything but the smallest of card collections this storage system represents considerable bulk and necessitates the additional expense of 3-ring binders.

Another storage device widely available is comprised of a 2 piece, rigid plastic, "clam shell" container. A single card is sandwiched between two plastic plates which are a snap fit, one within the other.

This device offers protection against bending and twisting of the card but, like the envelope system, provides no means of organizing the collection in logical order. Each container is capable of housing only a single card. Removal of the card from the container can be difficult, requiring both halves of the "clam shell" to be prised apart.

A fourth storage device, most recently made available, is essentially a rigid plastic box incorporating a hinged lid with a snap close, snap open action. This device overcomes many of the shortcomings of the previously described storage systems in that it protects against bending and twisting; provides for the storage of multiple cards (up to 100), and maintains the cards in logical order.

The drawbacks to this latter storage system are that the lid hinge is not integral to the plastic material but rather a snap fit arrangement which tends to break. The construction material is brittle and cracks with the application of modest twisting forces. Retrieval of any one particular card, or series of cards, can only be achieved by first removing all the cards. (First in; Last out.)

OBJECTS AND ADVANTAGES

Accordingly, besides the objects and advantages of the storage containers described above, several objects and advantages of the present patent are:

(a) to provide a container which can protect and store large quantities of cards;

(b) to provide a container which permits efficient retrieval of individual cards or series of cards on a random access basis; and (c) to provide a container which consumes the minimum amount of space consistent with maximum storage capabilities Further objects and advantages are to provide a container which can be used easily and conveniently, and can be manufactured inexpensively, without the requirement of specially constructed tooling and/or moulds.

Still further objects and advantages will become apparent from a consideration of the ensuing description and drawings.

DRAWING FIGURES

In the drawings, closely related figures have the same number but different alphabetical suffixes.

FIG. 1; is a perspective view of the storage container illustrating both the External Enclosure and the Internal Enclosure assembled in their relative operable positions.

Figure 2:
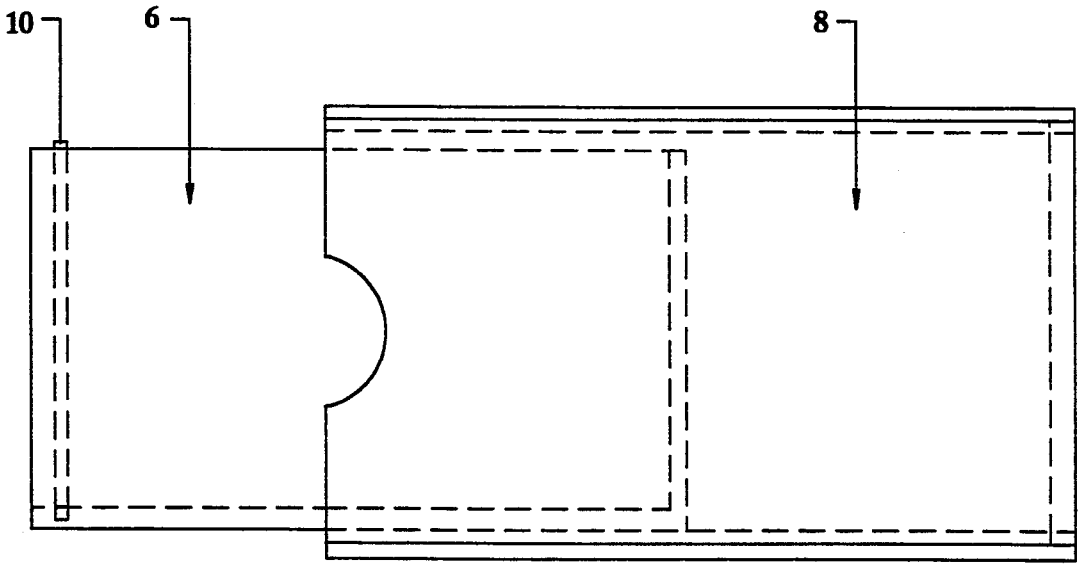

FIG. 2; is a side view of the storage container illustrating both the External Enclosure and the Internal Enclosure assembled in their relative operable positions.

Figure 3:
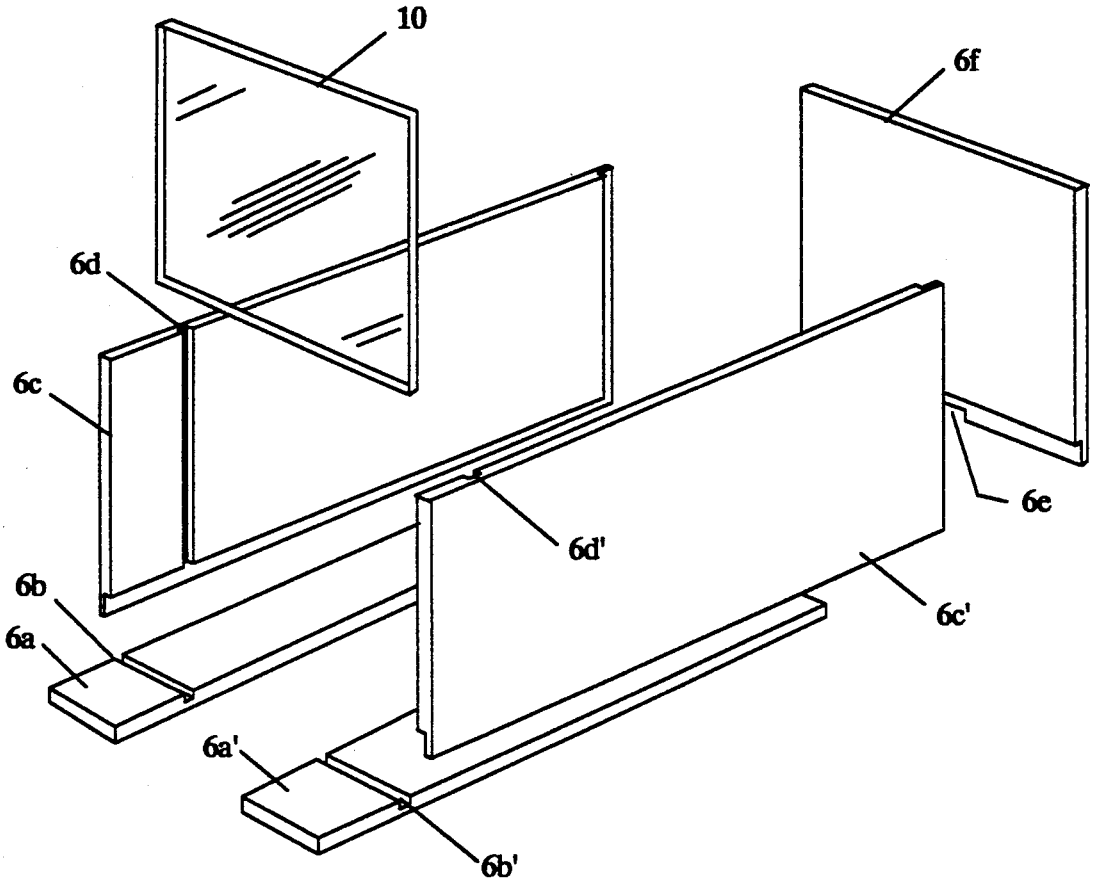

FIG. 3; is an exploded view of the Internal Enclosure illustrating the various components thereof.

Figure 3A:
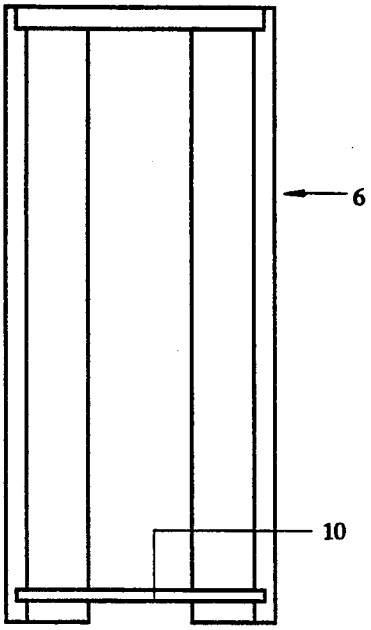
Figure 3B:
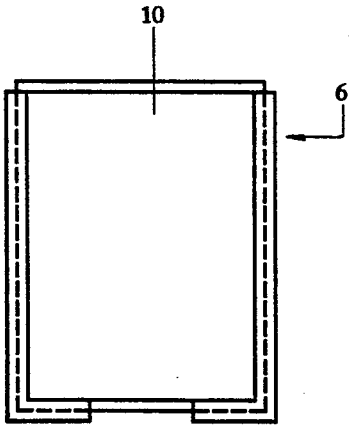
Figure 3C:
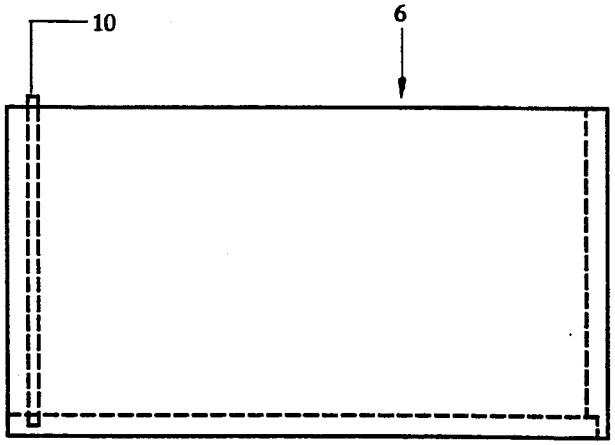

FIGS. 3A–3C show Top, Front and Side views of the Internal Enclosure.

Figure 4:
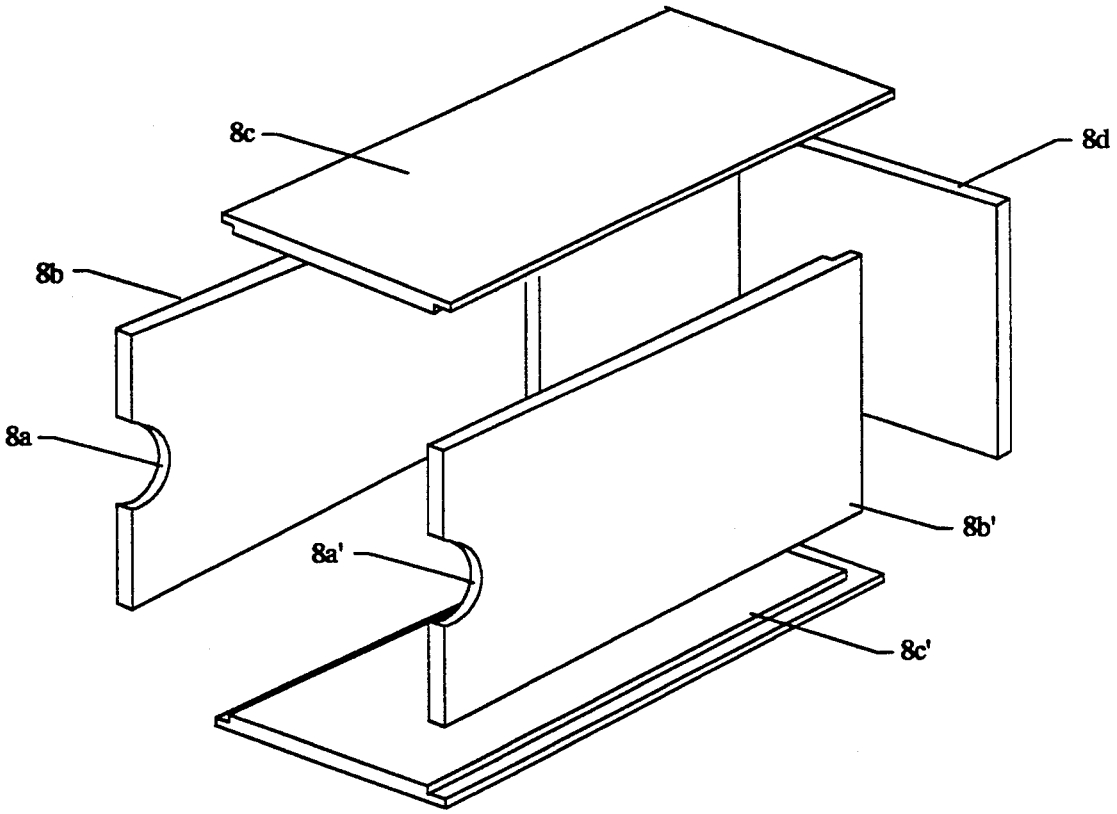

FIG. 4; is an exploded view of the External Enclosure illustrating the various components thereof.

Figure 4A:
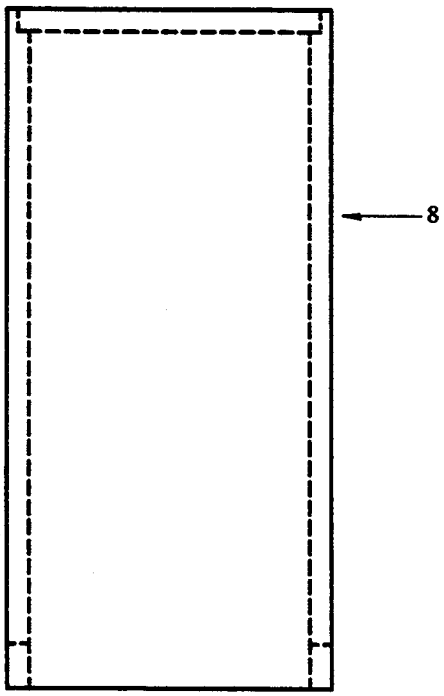
Figure 4B:
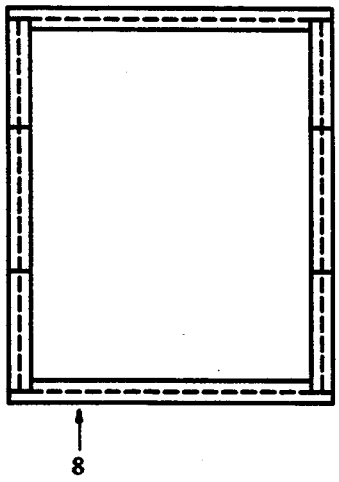
Figure 4C:
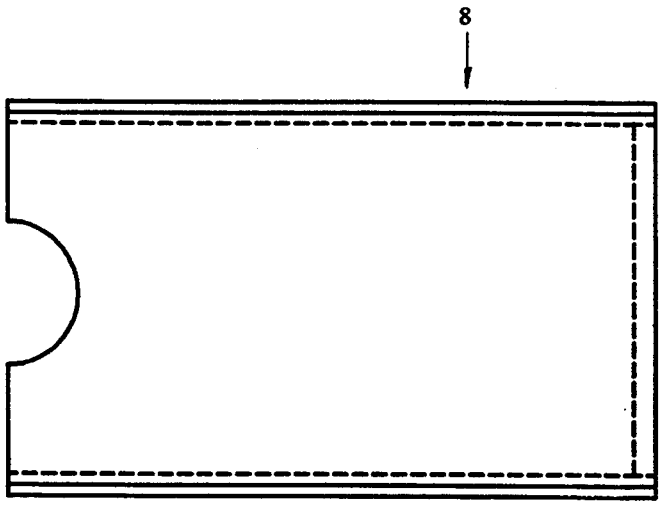

FIGS. 4A–4C show Top, Front and Side views of the External Enclosure.

| REFERENCE NUMERALS IN DRAWINGS | | | |
|---|---|---|---|
| | 6 Internal Enclosure | | |
| 6a | First Bottom Rail | 6a' | Second Bottom Rail |
| 6b | First Bottom Machined Groove | 6b' | Second Bottom Machined Groove |
| 6c | First Side Panel | 6c' | Second Side Panel |
| 6d | First Side Machined Groove | 6d' | Second Side Machined Groove |
| 6e | Rear Panel Cutout | 6f | Rear Panel |
| | 8 External Enclosure | | |
| 8a | First Fingergrip Cutout | 8a' | Second Fingergrip Cutout |
| 8b | First Side Wall | 8b' | Second Side Wall |
| 8c | Top Wall | 8c' | Bottom Wall |
| 8d | Rear Wall | | |
| 10 | Transparent Insert | | |

DESCRIPTION—FIGS. 1 TO 4A

A typical embodiment of the present invention is illustrated in FIG. 1 (perspective view) and in FIG. 2 (side view). The invention consists of an External Enclosure 8 and an Internal Enclosure 6. The Internal Enclosure 6 is free to slide in and out within the confines of the External Enclosure 8 and is completely removable from the External Enclosure 8.

As illustrated in FIG. 3, the Internal Enclosure 6 is comprised of a First Bottom Rail 6a and Second Bottom Rail 6a'; a First Side Panel 6c and Second Side Panel 6c'; a Rear Panel 6f and a Transparent Insert 10. All such components are generally rectangular, flat pieces of uniform thickness.

Both Side Panel, 6c and Side Panel 6c', incorporate each, two half joints, one of which extends along the inside bottom edge the full length of the panel, with dimensions sufficient to provide a clearance fit to the material thickness of Bottom Rail 6a and Bottom Rail 6a'. The second of each half joint extends along the inside rear edge, the full height of the panel, with dimensions sufficient to provide a clearance fit to the material thickness of the Rear Panel 6f.

Set back from the inside front edge of Side Panel 6c and Side Panels 6c' is a vertical track incorporating a First and Second Side Machined Groove, 6d and 6d' respectively. Each extending from the respective upper edge of the half joint to the respective top edge of each panel. And each of a depth approximately half the width of the panel and of a dimension sufficient to provide a clearance fit to the material thickness of the Transparent Insert 10.

Set back from the top front edge of Bottom Rail 6a and Bottom Rail 6a' are horizontal tracks incorporating First and Second Bottom Machined Grooves 6b and 6b'. Each extending the full width of their respective Rails, and each of a depth approximately half the Rail material thickness. And of a dimension sufficient to provide a clearance fit to the material thickness of the Transparent Insert 10.

The Rear Panel 6f incorporates a half joint which extends along the inside bottom edge the full width of the panel. Incorporated within the confines of the half joint is a Rear Panel Cutout 6e creating a void located centrally on the Rear Panel 6f and consuming approximately one third the width of the panel.

FIG. 3A illustrates the Top, Front and Side views of the assembled Internal Enclosure 6. In the assembled position, the Rear Panel 6f, transversely communicates with, and is affixed to, each of the rearwardly positioned, vertical half joints of Side Panel 6c and Side Panel 6c'.

The outwardly facing edge of Bottom Rail 6a communicates with, and is affixed to the bottom half joint of Side Panel 6c and the rearwardly facing edge of Bottom Rail 6a communicates with, and is affixed to the bottom half joint of Rear Panel 6f such that the Bottom Machined Groove 6b aligns with, and is perpendicular to, the Side Machined Groove 6d.

The outwardly facing edge of Bottom Rail 6a' communicates with, and is affixed to the bottom half joint of Side Panel 6c' and the rearwardly facing edge of Bottom Rail 6a' communicates with and is affixed to the bottom half joint of the Rear Panel 6f such that the Bottom Machined Groove 6b' aligns with, and is perpendicular to, the Side Machined Groove 6d'.

The Transparent Insert 10 transversely communicates with, and is affixed to, the track formed by the alignment of the First Side and First Bottom and Second Side and Second Bottom Machined Grooves, 6d, 6b, 6d' and 6b' respectively.

The Internal Enclosure 6 thus formed is generally rectangular in shape with closed sides and rear, a see-thru front panel and an open top. The bottom incorporates an aperture, located centrally, consuming approximately one third of the overall enclosure width and extending the full length of the enclosure. The overall internal width of the enclosure is such as to provide a clearance fit to the width of a typical sports card. The overall length of the enclosure is such as to provide sufficient capacity for the containment of approximately 800 such cards stored vertically.

As illustrated in FIG. 4, the External Enclosure 8 is comprised of a First Side Wall 8b; a Second Side Wall 8b'; a Top Wall 8c; a Bottom Wall 8c'; and a Rear Wall 8d.

All such components are generally rectangular, flat pieces of uniform thickness.

Both Side Walls 8b and 8b' incorporate each, a half joint which extends along the inside rear edge, the full height of the wall. Dimensions are such as is sufficient to provide a clearance fit to the material thickness of the Rear Wall 8d.

A First Fingergrip Cutout 8a and a Second Fingergrip Cutout 8a' is incorporated into the front edge of Side Wall 8b and Side Wall 8b'. The Cutouts 8a and 8a' are semicircular in shape with a diameter approximately equal to one third the height of the side wall and are located centrally along the front edge of each Side Wall.

The Top Wall 8c incorporates three half joints, two of which are located along the inwardly facing edges and extend the full length of the wall. The third half joint is located along the inwardly facing rear edge and extends the full width of the wall.

The Bottom Wall 8c' incorporates three half joints, two of which are located along the inwardly facing edges and extend the full length of the wall. The third half joint is located along the inwardly facing rear edge and extends the full width of the wall.

FIG. 4A illustrates the Top, Front and Side views of the assembled External Enclosure 8. In the assembled position the bottom edge of Side Wall 8b and Side Wall 8b' communicate with, and are affixed to, the half joints on either side of the Bottom Wall 8c'. The top edge of Side Wall 8b and Side Wall 8b' communicate with, and are affixed to, the half joints on either side of the Top Wall 8c. The Rear Wall 8d communicates with and is affixed within the confines of the cavity created by the combination of inwardly facing half joints located at the rear edges of walls 8b, 8b', 8c and 8c' respectively.

The container thus formed is generally rectangular in shape with a closed top, bottom, sides and rear, and an open front. The overall internal width of the enclosure is of a dimension sufficient to provide a clearance fit to the external width of the Internal Enclosure 6. The overall length is such that the Internal Enclosure 6 may be inserted to a depth which results in the alignment of the front edges of both enclosures.

From the description above, a number of advantages of our card storage container become evident:

(a) a large number of cards can be stored;

(b) cards can be stored sequentially in any logical order; and (c) neither the Internal or External Enclosures incorporates any moving parts thus reducing the potential for breakage.

OPERATION—FIGS, 1, 2, 3, AND 4

The manner of using the Card Storage Container is as follows:

The container is supported in one hand by grasping the External Enclosure 8. The thumb and forefinger of the other hand grasp the front edges of the Internal Enclosure 6 exposed by the Fingergrip Cutouts 8a and 8a'. The Internal Enclosure 6 is withdrawn and removed from within the External Enclosure 8.

The sports cards are placed into the Internal Enclosure 6, one behind the other, in sequential order, short side up. The first card (the card closest to the front of the enclosure) may be turned face out or in against the Transparent Insert 10. The Internal Enclosure 6, complete with cards, can then be inserted into the open end of the External Enclosure 8 and slid all the way into the External Enclosure 8.

To remove any given card or sequence of cards, the Internal Enclosure 6 may be partially or completely removed from the External Enclosure 8. A finger, or fingers is inserted into the gap between the Bottom Rails 6a and 6a' and pushed upward, thus forcing any given card, or series of cards, upwardly out of the card stack. In this fashion access to cards within the stored stack is gained at random and cards may be removed without risk of damage.

SUMMARY, RAMIFICATIONS AND SCOPE

Accordingly, the reader will see that the sports card container described herein offers a robust, secure housing for a large quantity of cards while minimizing space requirements relative to other systems.

In addition, the invention, as presented, permits the organized storage of such cards and affords random access to any given card or series of cards within the card collection.

The invention, as presented, is easy to manufacture, requiring no specialized tooling or moulds.

Although the description above contains many specifications, these should not be construed as limiting the scope of the invention but as merely providing illustrations of some of the presently preferred embodiments of this invention. For example, the various walls and panels of the enclosures may be cut in a single pattern and folded together using an outer skin of vinyl as hinge points. Or the front transparent insert may be replaced by a flip up lid etc.

Thus the scope of the invention should be determined by the appended claims and their legal equivalents, rather than by the examples given.

We claim:

1. A container for the storage of multiple sports cards whereby said cards are maintained in pristine condition, comprising:

(a) an external enclosure having a plurality of walls each of said walls being fixed in relationship to the other and forming a generally rectangular shaped container open at one end; and (b) an internal enclosure having a transparent front wall for viewing the cards, a rear wall, two side walls and two bottom walls with said walls cooperating to form a generally rectangular shaped container open at the top with a longitudinal aperture at the bottom comprising a random access means to facilitate the retrieval of any given card and said internal enclosure constructed to be separable from said external enclosure and slidably insertable and removable in said external enclosure.

2. The internal enclosure of claim 1, wherein said rear, bottom and side walls consist of wood.

3. The internal enclosure of claim 1, wherein said longitudinal aperture is formed by a gap between said bottom walls and extends the full length of said bottom walls.

4. The internal enclosure of claim 1, wherein said internal enclosure is of a length to provide a flush fit with said external enclosure when fully inserted in said external enclosure.

5. The external enclosure of claim 1, wherein said walls consist of wood.

6. The external enclosure of claim 1, further including an access means to facilitate removal of said internal enclosure.

7. The external enclosure of claim 6, wherein said access means consists of finger sized notches centrally located on the open end of each of the vertically positioned said walls.

* * * * *